US010883798B1

(12) United States Patent
Chang

(10) Patent No.: US 10,883,798 B1
(45) Date of Patent: Jan. 5, 2021

(54) ADJUSTABLE SCOPE MOUNT FOR FIREARMS

(71) Applicant: Strike Industries, Inc., Santa Ana, CA (US)

(72) Inventor: Isaac Chang, Placentia, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 16/512,292

(22) Filed: Jul. 15, 2019

(51) Int. Cl.
*F41G 11/00* (2006.01)

(52) U.S. Cl.
CPC ..... *F41G 11/003* (2013.01)

(58) Field of Classification Search
CPC ..... F41G 11/004; F41G 11/003
USPC ..... 42/124–127
See application file for complete search history.

(56) References Cited

U.S. PATENT DOCUMENTS 4,845,871 A * 7/1989 Swan ..... F16M 13/00 42/127
5,531,039 A * 7/1996 Gore ..... F41G 11/002 42/124
7,694,450 B2 * 4/2010 Keng ..... F41G 11/003 42/124
8,720,103 B2 * 5/2014 Schultz ..... F41G 11/003 42/127

* cited by examiner

*Primary Examiner* — Reginald S Tillman, Jr.
(74) *Attorney, Agent, or Firm* — Han IP PLLC; Andy M. Han

(57) ABSTRACT

A scope mount implementable on a firearm includes a base and an adjustable cantilever. The base has a first primary side and a second primary side opposite the first primary side, with the second primary side configured to accommodate and mount onto a rail on the firearm. The adjustable cantilever is slidingly installable on the first primary side of the base and is configured with a scope mounting feature to receive a scope thereon. The adjustable cantilever can be fixable at one of plural positions along a longitudinal axis of the base and on the base such that a total length of the scope mount, measured from one distal end of the scope mount to an opposite distal end of the scope mount, varies between a shortest length and a longest length according to at which one of the positions on the base the adjustable cantilever is fixed.

16 Claims, 6 Drawing Sheets

ADJUSTABLE SCOPE MOUNT FOR FIREARMS

TECHNICAL FIELD

The present disclosure is generally related to firearms and, more particularly, to an adjustable scope mount for firearms.

BACKGROUND

Unless otherwise indicated herein, approaches described in this section are not prior art to the claims listed below and are not admitted as prior art by inclusion in this section.

Generally, a scope mount is a device that is used to mount a scope onto a firearm, which may be a rifle, carbine, pistol or shotgun. Scope mounts generally come in two types—namely one-piece scope mounts and two-piece scope mounts. In a one-piece scope mount, two scope mounting rings are fixedly connected to a cantilever mount whereas, in a two-piece scope mount, two scope mounting rings are separate from each other and are individually mounted onto a firearm. Compared to two-piece scope mounts, one-piece scope mounts tend to be stronger and more rigid, thus providing more support and stability for the scope. However, given that a cantilever distance of a given one-piece scope mounts is fixed, a user would need to purchase multiple one-piece scope mounts with different cantilever distances in case the user desires to change the distance to suit his/her needs (e.g., to change the eye relief and/or to use different scopes having different dimensions).

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issue, an objective of the present disclosure is to provide an innovative design of an adjustable scope mount that allows a user to set the cantilever distance which would work best for the user. Advantageously, this would avoid the need for the user to purchase or otherwise have multiple scope mounts with different cantilever distances.

In one aspect, a scope mount implementable on a firearm may include a base and an adjustable cantilever. The base may have a first primary side and a second primary side opposite the first primary side, with the second primary side configured to accommodate and mount onto a rail on the firearm. The adjustable cantilever may be slidingly installable on the first primary side of the base and may be configured with a scope mounting feature to receive a scope thereon. The adjustable cantilever may be also configured to be fixable at one of a plurality of positions along a longitudinal axis of the base and on the base such that a total length of the scope mount, measured from one distal end of the scope mount to an opposite distal end of the scope mount, varies between a shortest length and a longest length according to at which one of the plurality of positions on the base the adjustable cantilever is fixed.

In one aspect, a device implementable on a firearm may include a scope mount that is adjustable in length. The scope mount may include a base and an adjustable cantilever. The base may have a first primary side and a second primary side opposite the first primary side, with the second primary side configured to accommodate and mount onto a rail on the firearm. The adjustable cantilever may be slidingly installable on the first primary side of the base, the adjustable cantilever configured with a scope mounting feature to receive a scope thereon.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
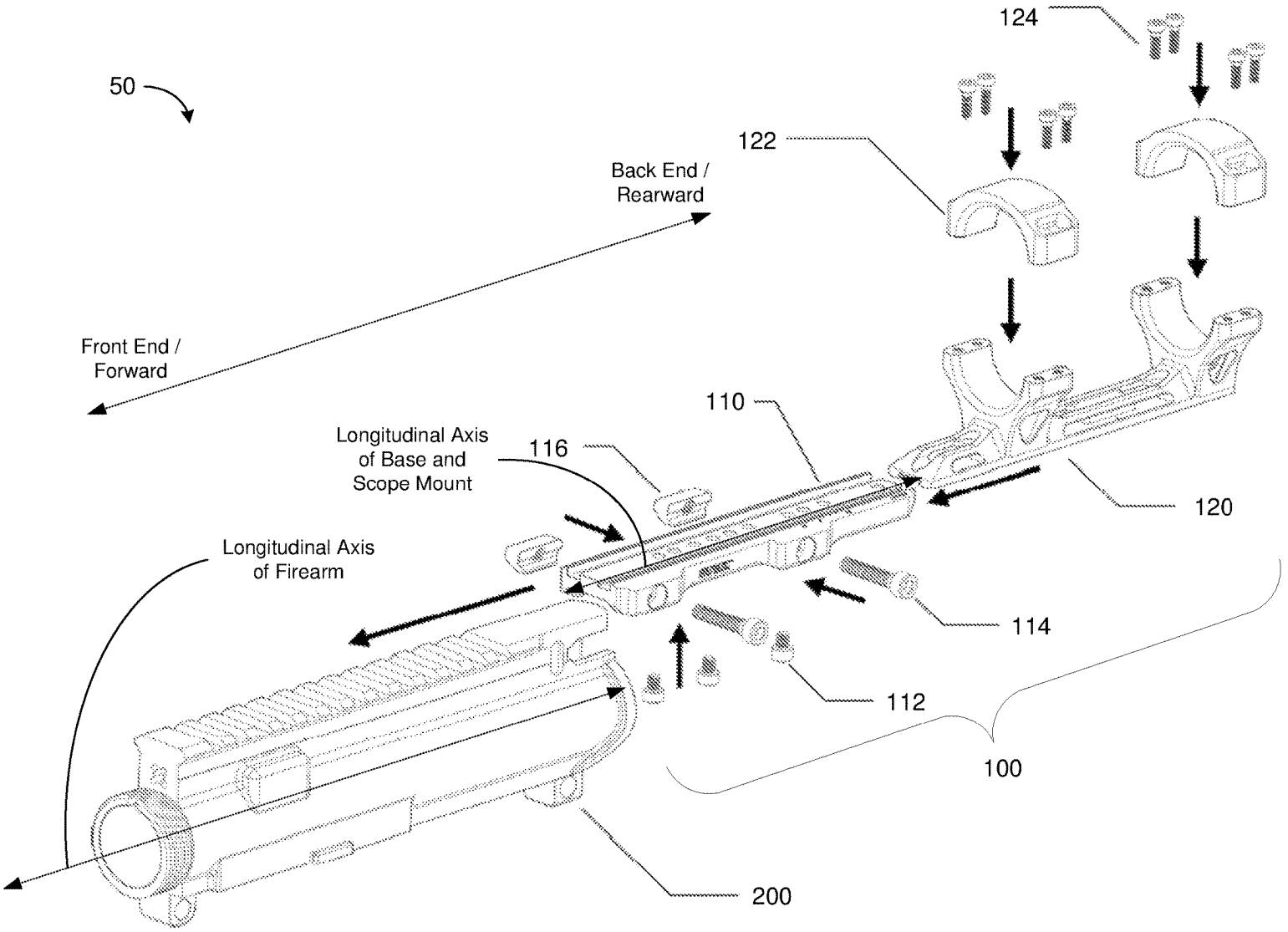
FIG. 1 is a diagram of an exploded view of an apparatus in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

FIG. 1 illustrates an exploded view of an apparatus 50 in accordance with an implementation of the present disclosure. Apparatus 50 may be a combination of a firearm 200 and an adjustable scope mount 100 in accordance with the present disclosure. Firearm 200 may be a rifle, carbine, pistol or shotgun. For simplicity and to avoid obscuring other components in the figure, firearm 200 is represented by an AR-15 upper receiver in FIG. 1 although firearm 200 may not necessarily be an AR-15 type of rifle or pistol. Firearm 200 may have a rail thereon. The rail may be a Picatinny rail. Alternatively, the rail may be a MIL-STD-1913 rail, a Standardization Agreement 2324 rail, a Weaver rail, a STANAG 4694 rail, or a NATO accessory rail. Regardless of the type of rail, adjustable scope mount 100 may be mountable on the rail of firearm 200.

Under a proposed design in accordance with the present disclosure, adjustable scope mount 100 may be adjustable in length. Adjustable scope mount 100 may include a base 110 and an adjustable cantilever 120. Base 110 may have a first primary side (e.g., top side with respect to firearm 200) and a second primary side (e.g., bottom side with respect to firearm 200) which is opposite the first primary side. The second primary side of base 110 may be configured to accommodate and mount onto the rail on firearm 200. Adjustable cantilever 120 may be slidingly installable on the first primary side of base 110. Moreover, adjustable cantilever 120 may be configured with one or more scope mounting features (e.g., one or more contours or protrusions each shaped like a lower half of a scope mounting ring) to receive a scope thereon. Furthermore, adjustable cantilever 120 may be configured to be fixable at one of a plurality of positions along a longitudinal axis of base 110 (which is also the longitudinal axis of adjustable scope mount 100 and is parallel to the longitudinal axis of firearm 200) and on base 110 such that a total length of adjustable scope mount 100, measured from one distal end (e.g., front end) of adjustable scope mount to an opposite distal end (e.g., back end) of adjustable scope mount 100, may vary between a shortest length and a longest length according to at which one of the plurality of positions on base 110 adjustable cantilever 120 is fixed.

Figure 2:
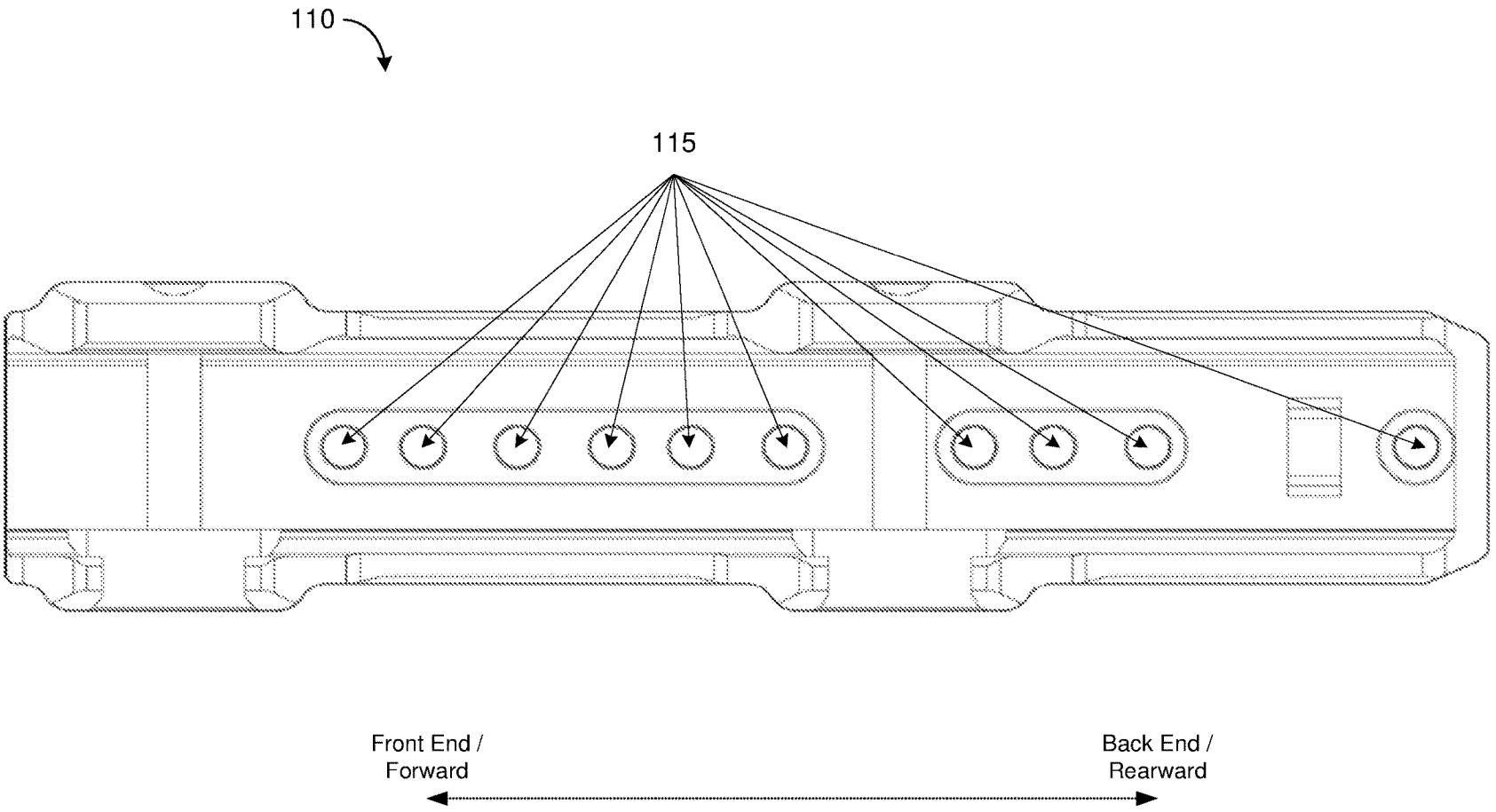
FIG. 2 is a diagram of a top view of a base of an adjustable scope mount in accordance with an implementation of the present disclosure.
Figure 3:
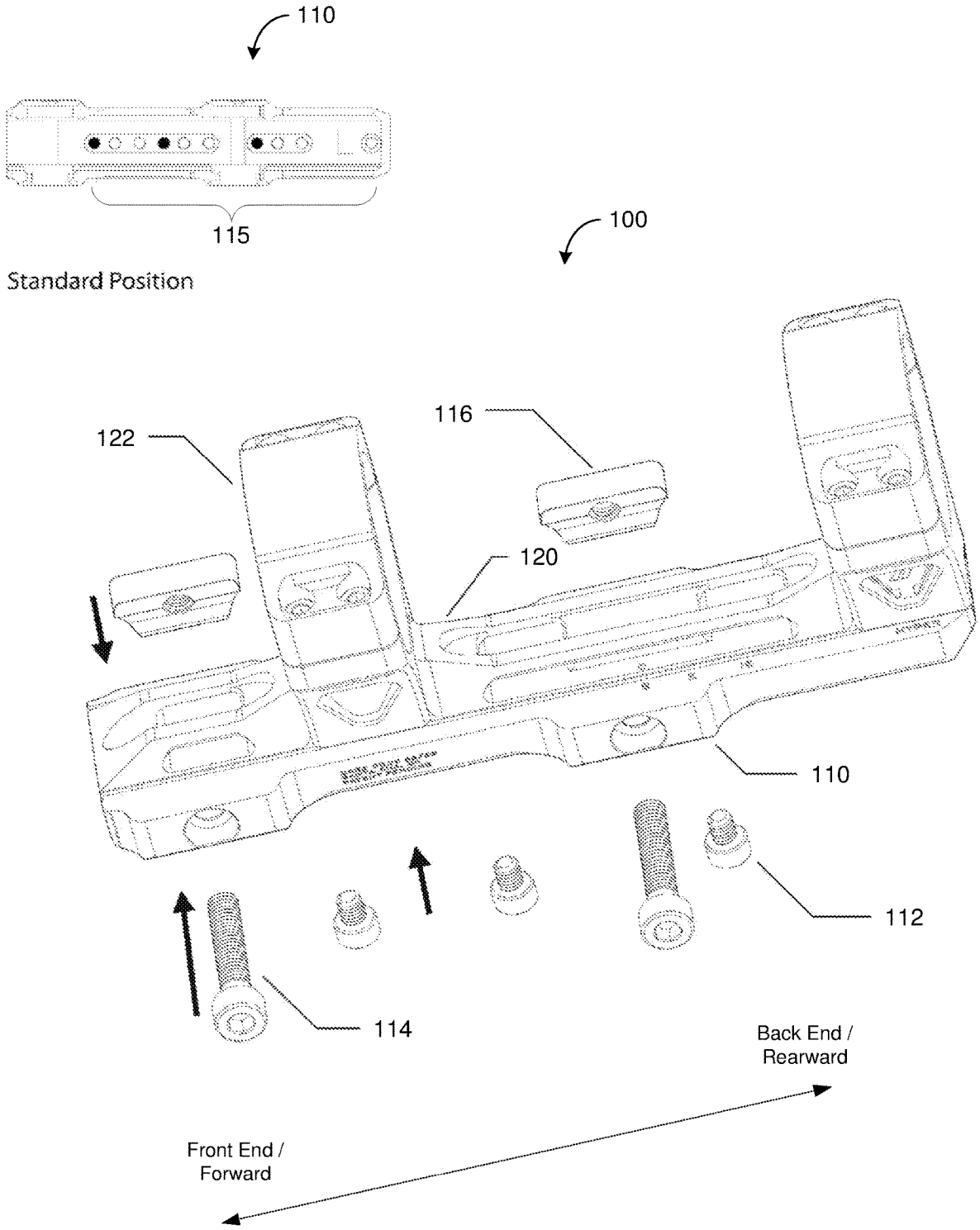
FIG. 3 is a diagram of a perspective view of an adjustable scope mount in a first configuration in accordance with an implementation of the present disclosure.
Figure 4:
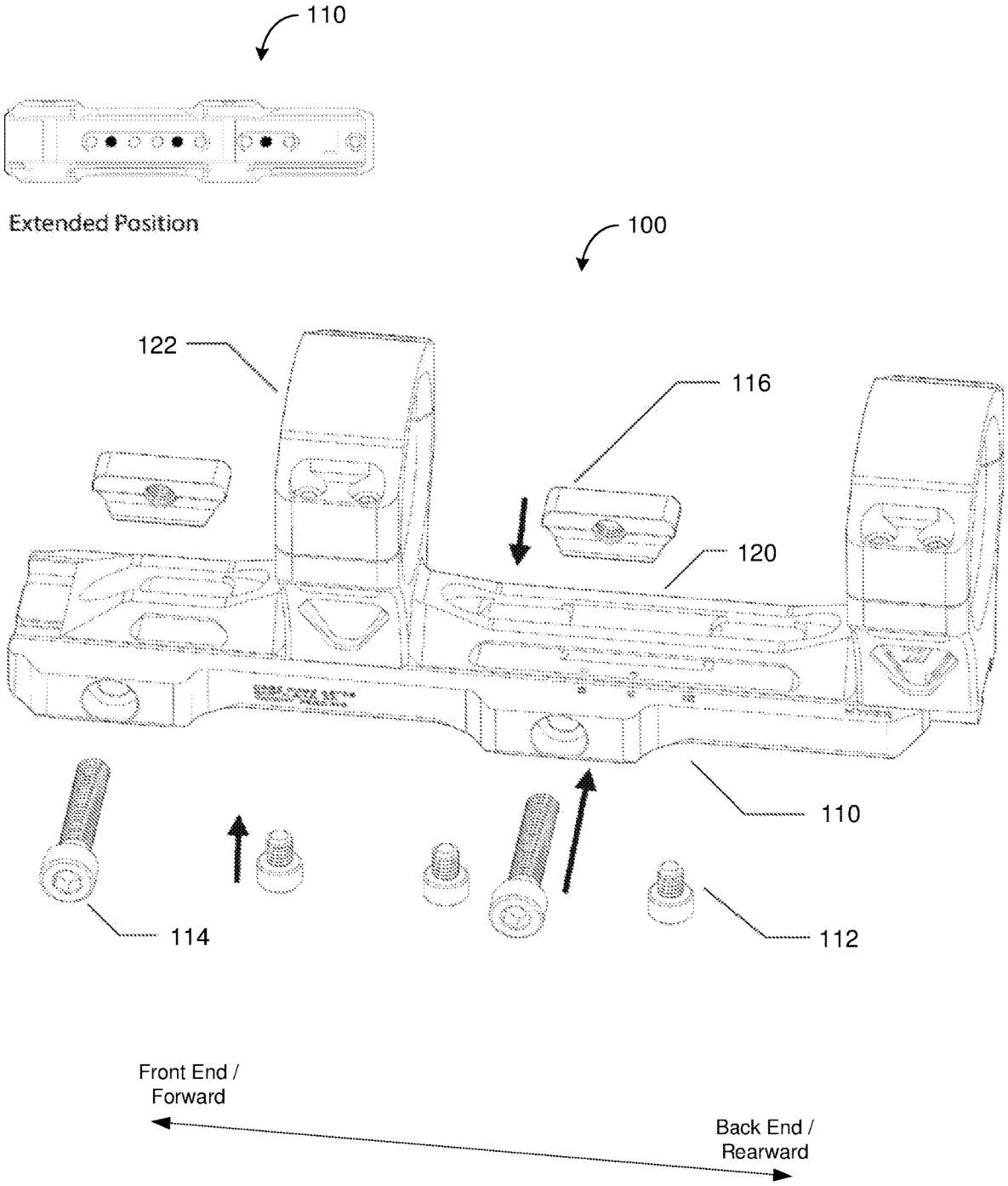
FIG. 4 is a diagram of a perspective view of the adjustable scope mount in a second configuration in accordance with an implementation of the present disclosure.
Figure 5:
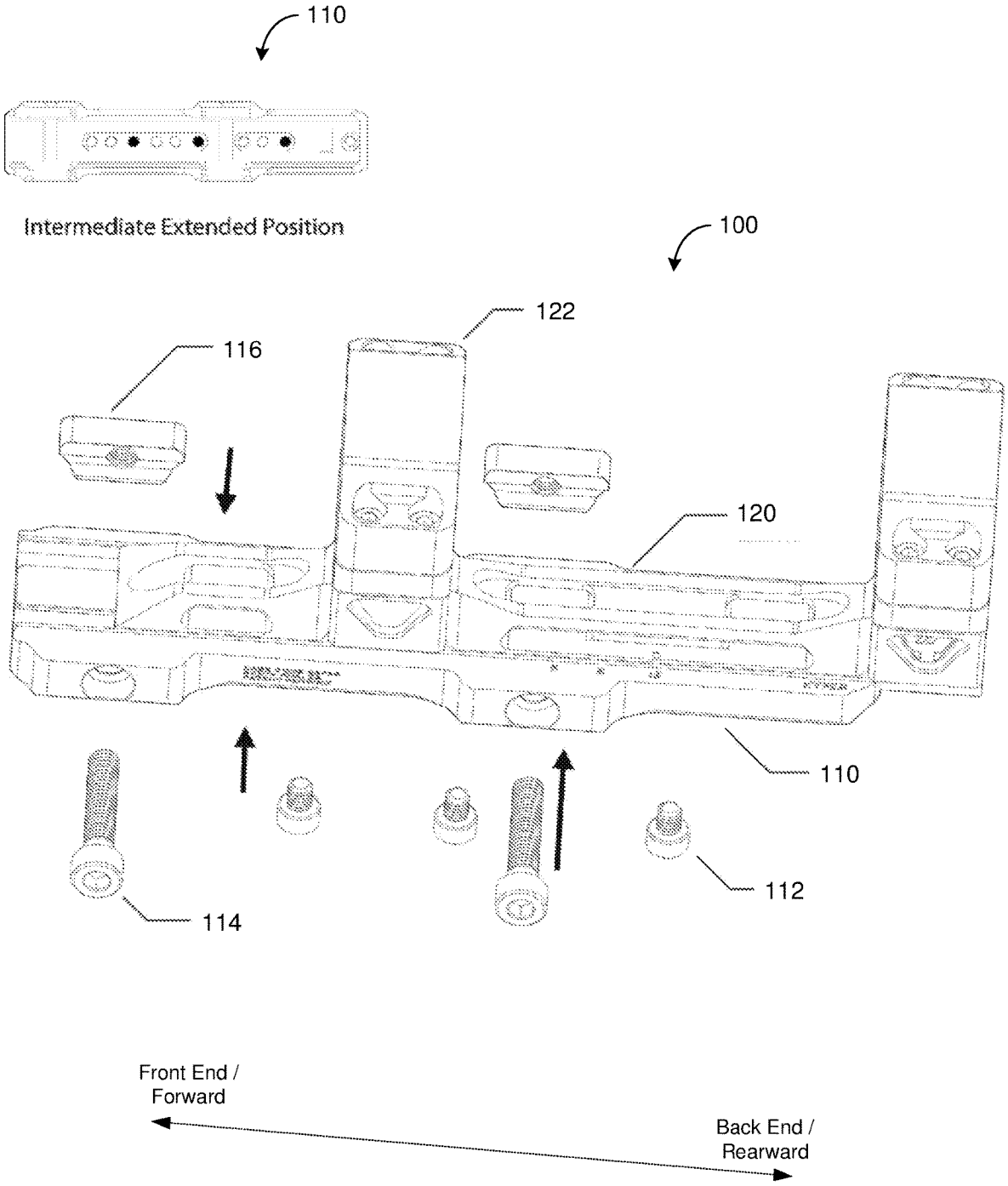
FIG. 5 is a diagram of a perspective view of the adjustable scope mount in a third configuration in accordance with an implementation of the present disclosure.
Figure 6:
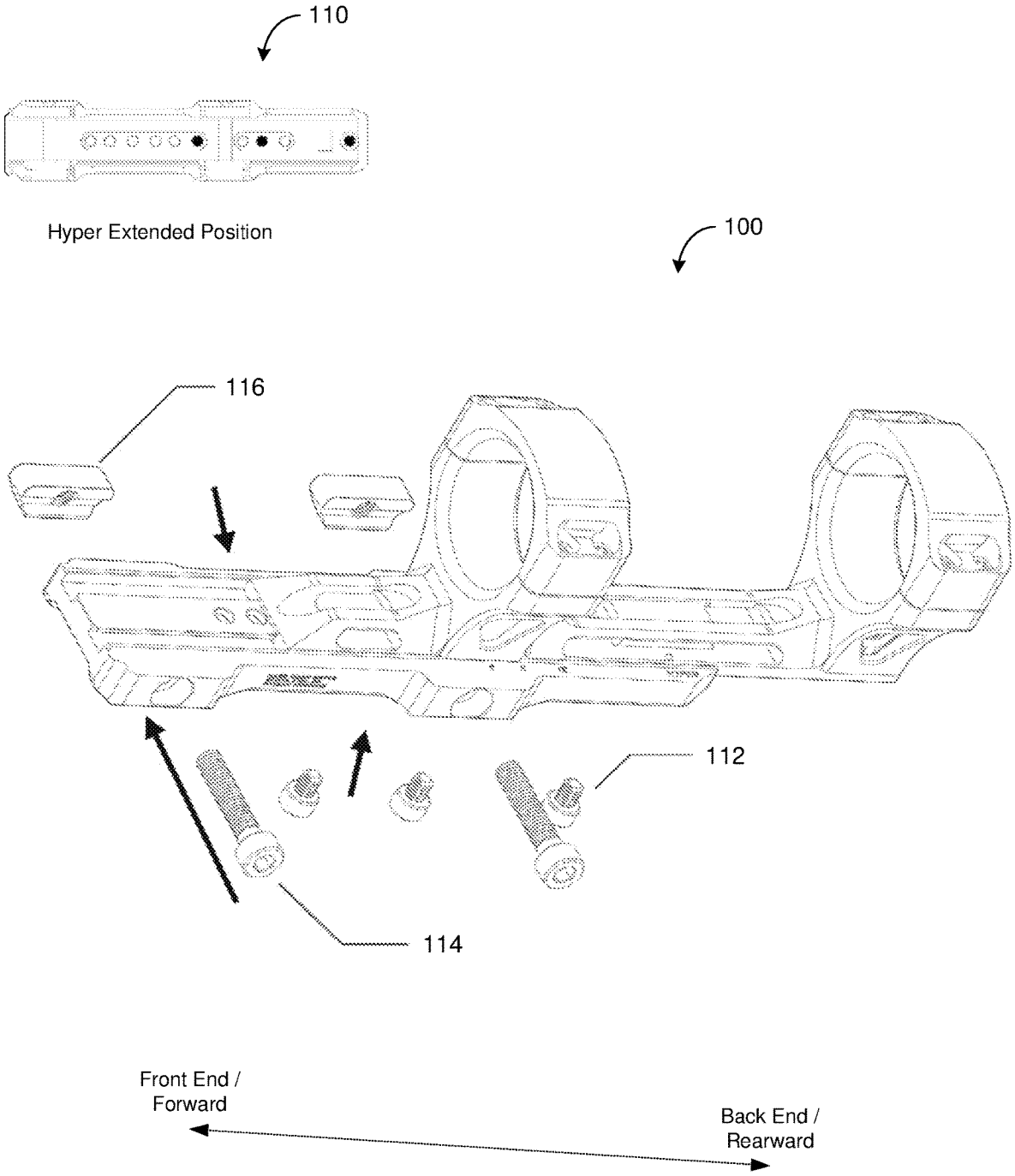
FIG. 6 is a diagram of a perspective view of the adjustable scope mount in a fourth configuration in accordance with an implementation of the present disclosure.

FIG. 2 illustrates a top view of base 110 of adjustable scope mount 100 in accordance with an implementation of the present disclosure. FIG. 3 illustrates a perspective view of adjustable scope mount 100 in a first configuration in accordance with an implementation of the present disclosure. FIG. 4 illustrates a perspective view of adjustable scope mount 100 in a second configuration in accordance with an implementation of the present disclosure. FIG. 5 illustrates a perspective view of adjustable scope mount 100 in a third configuration in accordance with an implementation of the present disclosure. FIG. 6 illustrates a perspective view of adjustable scope mount 100 in a fourth configuration in accordance with an implementation of the present disclosure. The following description of adjustable scope mount 100 is provided with reference to FIG. 1~FIG. 6.

Adjustable scope mount 100 may also include one or more adjustable cantilever screws 112 configured to fix adjustable cantilever 120 at one of the plurality of positions on base 110. The plurality of positions may include, for example and without limitation, four positions/configurations such as: a standard position (or the first configuration), an extended position (or the second configuration), an intermediate extended position (or the third configuration), and a hyper extended position (or the fourth configuration). Adjustable cantilever 120 may include a plurality of screw holes (not shown). As shown in FIG. 2, base 110 may include a plurality of through holes 115 through which the one or more adjustable cantilever screws 112 may be screwed into one or more of the plurality of screw holes on adjustable cantilever 120 to fix or otherwise secure adjustable cantilever 120 at one of the plurality of positions on base 110. As shown in the upper-left corner of each of FIG. 3~FIG. 6, black circles represent those screw holes among the plurality of through holes 115 on base 110 that have adjustable cantilever screws 112 screwed therein while white circles represent those screw holes among the plurality of through holes 115 on base 110 that do not. Moreover, in each of FIG. 3~FIG. 6, the black circles represent the locations of adjustable cantilever screws 112 for fixing adjustable cantilever 120 at the respective position, namely: standard position, extended position, intermediate extended position, and hyper extended position.

Under the proposed design, adjustable cantilever 120 may be slidingly installable on base 110 in two orientations—namely, a first orientation and a second orientation. In the first orientation of the two orientations, a first distal end (e.g., front end) of adjustable cantilever 120 and a first distal end (e.g., front end) of base 110 may point toward a front end of firearm 200 while a second distal end (e.g., back end) of adjustable cantilever 120 and a second distal end (e.g., back end) of base point toward a back end of firearm 200. Moreover, in the second orientation of the two orientations, the second distal end of adjustable cantilever 120 and the first distal end of base 110 may point toward the front end of firearm 200 while the first distal end of adjustable cantilever 120 and the second distal end of base 110 point toward the back end of firearm 200. That is, the orientation of adjustable cantilever 120 may be reversed when installed on base 110. Advantageously, this design may result in more eye reliefs than otherwise. For instance, with a scope (not shown) mounted on adjustable cantilever 120 which is in the first orientation and fixed at a given position of the plurality of positions, an eye relief may be a first distance. Additionally, with the scope mounted on adjustable cantilever 120 which is in the second orientation and fixed at the same position, the eye relief may be at a second distance different from the first distance.

Under the proposed design, scope mount 100 may also include two scope mount rings 122, each with two or more through holes, and a plurality of scope mount ring screws 124. In such cases, the one or more scope mounting features of adjustable cantilever 120 may include a plurality of screw holes such that, when the scope is disposed on the one or more scope mounting features of adjustable cantilever 120, the plurality of scope mount ring screws 124 may secure the scope to adjustable cantilever 120 by screwing into the plurality of screw holes on the one or more scope mounting features of adjustable cantilever 120 through the through holes of the two scope mount rings 122 with the scope sandwiched between the one or more scope mounting features of adjustable cantilever 120 and the two scope mount rings 122.

Under the proposed design, the second primary side (e.g., bottom side) of base 110 may be configured to accommodate and mount onto the rail of firearm 200 which may be a Picatinny rail. Alternatively, the second primary side of base 110 may be configured to accommodate and mount onto a MIL-STD-1913 rail, a Standardization Agreement 2324 rail, a Weaver rail, a STANAG 4694 rail, or a NATO accessory rail.

Under the proposed design, each of the one or more adjustable cantilever screws 112 may be screwed into a respective same screw hole of the plurality of screw holes on adjustable cantilever 120 regardless of which one of the plurality of positions on base 110 at which adjustable cantilever 120 is fixed. Alternatively, or additionally, the one or more adjustable cantilever screws 112 may be screwed through different through holes of the plurality of through holes 115 on base 110 between at least two positions of the plurality of positions on base 110 at which adjustable cantilever 120 is fixable.

Under the proposed design, scope mount 100 may also include one or more base screws 114 and one or more corresponding clamps 116 each with a screw hole configured to receive a respective one of the one or more base screws 114. In such cases, base 110 may include one or more through holes (which may be perpendicular to the longitudinal axis of base 110) through which the one or more base screws 114 traverse base 110 from a first peripheral side (e.g., left side) of base 110 to tighten the one or more clamps 116 on a second peripheral side (e.g., right side) of base 110 to fix or otherwise secure base 110 onto the rail of firearm 200 when base 110 is disposed on the rail.

Under the proposed design, each component of adjustable scope mount 100 may be made using a respective material that can withstand vibrations and shocks associated with the use of firearm 200 (e.g., due to firing of ammunition rounds). For instance, one or more components of adjustable scope mount 100 may be made of steel, alloy or any suitable metallic material.

Highlight of Select Features

In view of the above, select features of various implementations in accordance with the present disclosure are highlighted below.

In one aspect, a scope mount implementable on a firearm may include a base and an adjustable cantilever. The base may have a first primary side and a second primary side opposite the first primary side, with the second primary side configured to accommodate and mount onto a rail on the firearm. The adjustable cantilever may be slidingly installable on the first primary side of the base and may be configured with one or more scope mounting features to receive a scope thereon. The adjustable cantilever may be also configured to be fixable at one of a plurality of positions along a longitudinal axis of the base and on the base such that a total length of the scope mount, measured from one distal end of the scope mount to an opposite distal end of the scope mount, varies between a shortest length and a longest length according to at which one of the plurality of positions on the base the adjustable cantilever is fixed.

In some implementations, the adjustable cantilever may be slidingly installable on the base in two orientations. Accordingly, in a first orientation of the two orientations, a first distal end of the adjustable cantilever and a first distal end of the base may point toward a front end of the firearm while a second distal end of the adjustable cantilever and a second distal end of the base point toward a back end of the firearm. Moreover, in a second orientation of the two orientations, the second distal end of the adjustable cantilever and the first distal end of the base may point toward the front end of the firearm while the first distal end of the adjustable cantilever and the second distal end of the base point toward the back end of the firearm.

In some implementations, with the scope mounted on the adjustable cantilever which is in the first orientation and fixed at a first position of the plurality of positions, an eye relief may be a first distance. Additionally, with the scope mounted on the adjustable cantilever which is in the second orientation and fixed at the first position, the eye relief may be at a second distance different from the first distance.

In some implementations, the scope mount may also include two scope mount rings, each with two or more through holes, and a plurality of scope mount ring screws. In such cases, the one or more scope mounting features of the adjustable cantilever may include a plurality of screw holes such that, when the scope is disposed on the adjustable cantilever, the plurality of scope mount ring screws secure the scope to the adjustable cantilever by screwing into the plurality of screw holes on the one or more scope mounting features of the adjustable cantilever through the through holes of the two scope mount rings with the scope sandwiched between the one or more scope mounting features of the adjustable cantilever and the two scope mount rings.

In some implementations, the second primary side of the base may be configured to accommodate and mount onto a Picatinny rail on the firearm. Alternatively, the second primary side of the base may be configured to accommodate and mount onto a MIL-STD-1913 rail, a Standardization Agreement 2324 rail, a Weaver rail, a STANAG 4694 rail, or a NATO accessory rail.

In some implementations, the scope mount may also include one or more adjustable cantilever screws configured to fix the adjustable cantilever at one of the plurality of positions on the base.

In some implementations, the adjustable cantilever may include a plurality of screw holes. In such cases, the base may include a plurality of through holes through which the one or more adjustable cantilever screws may be screwed into one or more of the plurality of screw holes on the adjustable cantilever to fix the adjustable cantilever at one of the plurality of positions on the base.

In some implementations, each of the one or more adjustable cantilever screws may be screwed into a respective same screw hole of the plurality of screw holes on the adjustable cantilever regardless of which one of the plurality of positions on the base at which the adjustable cantilever is fixed.

In some implementations, the one or more adjustable cantilever screws may be screwed through different through holes of the plurality of through holes on the base between at least two positions of the plurality of positions on the base at which the adjustable cantilever is fixable.

In some implementations, the scope mount may also include a base screw and a clamp with a screw hole configured to receive the base screw. In such cases, the base may include a through hole through which the base screw traverses the base from a first peripheral side of the base to tighten the clamp on a second peripheral side of the base to fix the base onto the rail when the base is disposed on the rail.

In one aspect, a scope mount implementable on a firearm may include a base and an adjustable cantilever. The base may have a first primary side and a second primary side opposite the first primary side, with the second primary side configured to accommodate and mount onto a rail on the firearm. The adjustable cantilever may be disposed on the first primary side of the base and movable along a longitudinal axis of the base which is parallel to a longitudinal axis of the firearm such that the adjustable cantilever is fixable at one of a plurality of positions. The adjustable cantilever may be configured with a scope mounting feature to receive a scope thereon.

In some implementations, the adjustable cantilever may be slidingly installable on the base in two orientations. Accordingly, in a first orientation of the two orientations, a first distal end of the adjustable cantilever and a first distal end of the base may point toward a front end of the firearm while a second distal end of the adjustable cantilever and a second distal end of the base point toward a back end of the firearm. Moreover, in a second orientation of the two orientations, the second distal end of the adjustable cantilever and the first distal end of the base may point toward the front end of the firearm while the first distal end of the adjustable cantilever and the second distal end of the base point toward the back end of the firearm.

In some implementations, with the scope mounted on the adjustable cantilever which is in the first orientation and fixed at a first position of the plurality of positions, an eye relief may be a first distance. Additionally, with the scope mounted on the adjustable cantilever which is in the second orientation and fixed at the first position, the eye relief may be at a second distance different from the first distance.

In some implementations, the second primary side of the base may be configured to accommodate and mount onto a Picatinny rail on the firearm.

In one aspect, a device implementable on a firearm may include a scope mount that is adjustable in length. The scope mount may include a base and an adjustable cantilever. The base may have a first primary side and a second primary side opposite the first primary side, with the second primary side configured to accommodate and mount onto a rail on the firearm. The adjustable cantilever may be slidingly installable on the first primary side of the base and may be configured with one or more scope mounting features to receive a scope thereon. The device may also include the rail, the firearm and/or the scope.

In some implementations, the adjustable cantilever may be configured to be fixable at one of a plurality of positions along a longitudinal axis of the base and on the base such that a total length of the scope mount, measured from one distal end of the scope mount to an opposite distal end of the scope mount, varies between a shortest length and a longest length according to at which one of the plurality of positions on the base the adjustable cantilever is fixed.

In some implementations, the adjustable cantilever may be slidingly installable on the base in two orientations. In such cases, in a first orientation of the two orientations, a first distal end of the adjustable cantilever and a first distal end of the base may point toward a front end of the firearm while a second distal end of the adjustable cantilever and a second distal end of the base point toward a back end of the firearm. Moreover, in a second orientation of the two orientations, the second distal end of the adjustable cantilever and the first distal end of the base may point toward the front end of the firearm while the first distal end of the adjustable cantilever and the second distal end of the base point toward the back end of the firearm.

In some implementations, with the scope mounted on the adjustable cantilever which is in the first orientation and fixed at a first position of the plurality of positions, an eye relief may be a first distance. Additionally, with the scope mounted on the adjustable cantilever which is in the second orientation and fixed at the first position, the eye relief may be at a second distance different from the first distance.

In some implementations, the scope mount may also include two scope mount rings, each with two or more through holes, and a plurality of scope mount ring screws. In such cases, the one or more scope mounting features of the adjustable cantilever may include a plurality of screw holes such that, when the scope is disposed on the adjustable cantilever, the plurality of scope mount ring screws secure the scope to the adjustable cantilever by screwing into the plurality of screw holes on the one or more scope mounting features of the adjustable cantilever through the through holes of the two scope mount rings with the scope sandwiched between the one or more scope mounting features of the adjustable cantilever and the two scope mount rings.

In some implementations, the second primary side of the base may be configured to accommodate and mount onto a Picatinny rail on the firearm. Alternatively, the second primary side of the base may be configured to accommodate and mount onto a MIL-STD-1913 rail, a Standardization Agreement 2324 rail, a Weaver rail, a STANAG 4694 rail, or a NATO accessory rail.

In some implementations, the scope mount may also include one or more adjustable cantilever screws configured to fix the adjustable cantilever at one of the plurality of positions on the base.

In some implementations, the adjustable cantilever may include a plurality of screw holes. In such cases, the base may include a plurality of through holes through which the one or more adjustable cantilever screws may be screwed into one or more of the plurality of screw holes on the adjustable cantilever to fix the adjustable cantilever at one of the plurality of positions on the base.

In some implementations, each of the one or more adjustable cantilever screws may be screwed into a respective same screw hole of the plurality of screw holes on the adjustable cantilever regardless of which one of the plurality of positions on the base at which the adjustable cantilever is fixed.

In some implementations, the one or more adjustable cantilever screws may be screwed through different through holes of the plurality of through holes on the base between at least two positions of the plurality of positions on the base at which the adjustable cantilever is fixable.

In some implementations, the scope mount may also include a base screw and a clamp with a screw hole configured to receive the base screw. In such cases, the base may include a through hole through which the base screw traverses the base from a first peripheral side of the base to tighten the clamp on a second peripheral side of the base to fix the base onto the rail when the base is disposed on the rail.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A scope mount implementable on a firearm, comprising:

a base having a first primary side and a second primary side opposite the first primary side, the second primary side configured to accommodate and mount onto a rail on the firearm; and an adjustable cantilever slidingly installable on the first primary side of the base, the adjustable cantilever configured with a scope mounting feature to receive a scope thereon, the adjustable cantilever also configured to be fixable at one of a plurality of positions along a longitudinal axis of the base and on the base such that a total length of the scope mount, measured from one distal end of the scope mount to an opposite distal end of the scope mount, varies between a shortest length and a longest length according to at which one of the plurality of positions on the base the adjustable cantilever is fixed.

2. The scope mount of claim 1, wherein the adjustable cantilever is slidingly installable on the base in two orientations, wherein, in a first orientation of the two orientations, a first distal end of the adjustable cantilever and a first distal end of the base point toward a front end of the firearm while a second distal end of the adjustable cantilever and a second distal end of the base point toward a back end of the firearm, and wherein, in a second orientation of the two orientations, the second distal end of the adjustable cantilever and the first distal end of the base point toward the front end of the firearm while the first distal end of the adjustable cantilever and the second distal end of the base point toward the back end of the firearm.

3. The scope mount of claim 2, wherein, with the scope mounted on the adjustable cantilever which is in the first orientation and fixed at a first position of the plurality of positions, an eye relief is a first distance, and wherein, with the scope mounted on the adjustable cantilever which is in the second orientation and fixed at the first position, the eye relief is at a second distance different from the first distance.

4. The scope mount of claim 3, further comprising:

two scope mount rings each with two or more through holes; and a plurality of scope mount ring screws, wherein the scope mounting feature of the adjustable cantilever include a plurality of screw holes such that, when the scope is disposed on the adjustable cantilever, the plurality of scope mount ring screws secure the scope to the adjustable cantilever by screwing into the plurality of screw holes on the scope mounting feature of the adjustable cantilever through the through holes of the two scope mount rings with the scope sandwiched between the scope mounting feature of the adjustable cantilever and the two scope mount rings.

5. The scope mount of claim 1, wherein the second primary side of the base is configured to accommodate and mount onto a Picatinny rail on the firearm.

6. The scope mount of claim 1, further comprising:

one or more adjustable cantilever screws configured to fix the adjustable cantilever at one of the plurality of positions on the base.

7. The scope mount of claim 6, wherein the adjustable cantilever includes a plurality of screw holes, and wherein the base includes a plurality of through holes through which the one or more adjustable cantilever screws are screwed into one or more of the plurality of screw holes on the adjustable cantilever to fix the adjustable cantilever at one of the plurality of positions on the base.

8. The scope mount of claim 7, wherein each of the one or more adjustable cantilever screws is screwed into a respective same screw hole of the plurality of screw holes on the adjustable cantilever regardless of which one of the plurality of positions on the base at which the adjustable cantilever is fixed.

9. The scope mount of claim 7, wherein the one or more adjustable cantilever screws are screwed through different through holes of the plurality of through holes on the base between at least two positions of the plurality of positions on the base at which the adjustable cantilever is fixable.

10. The scope mount of claim 1, further comprising:

a base screw; and a clamp with a screw hole configured to receive the base screw, wherein the base includes a through hole through which the base screw traverses the base from a first peripheral side of the base to tighten the clamp on a second peripheral side of the base to fix the base onto the rail when the base is disposed on the rail.

11. A device implementable on a firearm, comprising:

a scope mount that is adjustable in length, the scope mount comprising:

a base having a first primary side and a second primary side opposite the first primary side, the second primary side configured to accommodate and mount onto a rail on the firearm; and an adjustable cantilever slidingly installable on the first primary side of the base, the adjustable cantilever configured with a scope mounting feature to receive a scope thereon.

12. The device of claim 11, wherein the adjustable cantilever is configured to be fixable at one of a plurality of positions along a longitudinal axis of the base and on the base such that a total length of the scope mount, measured from one distal end of the scope mount to an opposite distal end of the scope mount, varies between a shortest length and a longest length according to at which one of the plurality of positions on the base the adjustable cantilever is fixed.

13. The device of claim 12, wherein the adjustable cantilever is slidingly installable on the base in two orientations, wherein, in a first orientation of the two orientations, a first distal end of the adjustable cantilever and a first distal end of the base point toward a front end of the firearm while a second distal end of the adjustable cantilever and a second distal end of the base point toward a back end of the firearm, and wherein, in a second orientation of the two orientations, the second distal end of the adjustable cantilever and the first distal end of the base point toward the front end of the firearm while the first distal end of the adjustable cantilever and the second distal end of the base point toward the back end of the firearm.

14. The device of claim 13, wherein, with the scope mounted on the adjustable cantilever which is in the first orientation and fixed at a first position of the plurality of positions, an eye relief is a first distance, and wherein, with the scope mounted on the adjustable cantilever which is in the second orientation and fixed at the first position, the eye relief is at a second distance different from the first distance.

15. The device mount of claim 14, wherein the scope mount further comprises:

two scope mount rings each with two or more through holes; and a plurality of scope mount ring screws, wherein the scope mounting feature of the adjustable cantilever include a plurality of screw holes such that, when the scope is disposed on the adjustable cantilever, the plurality of scope mount ring screws secure the scope to the adjustable cantilever by screwing into the plurality of screw holes on the scope mounting feature of the adjustable cantilever through the through holes of the two scope mount rings with the scope sandwiched between the scope mounting feature of the adjustable cantilever and the two scope mount rings.

16. The device of claim 11, wherein the second primary side of the base is configured to accommodate and mount onto a Picatinny rail on the firearm.

* * * * *